US011052416B2

(12) United States Patent
Brugger

(10) Patent No.: US 11,052,416 B2
(45) Date of Patent: Jul. 6, 2021

(54) DOSING DISPENSER FOR DOSING OF AT LEAST ONE MATERIAL COMPONENT RECEIVED IN A RECEIVING COMPARTMENT

(71) Applicant: Gerhard Brugger, Pflach (AT)

(72) Inventor: Gerhard Brugger, Pflach (AT)

( * ) Notice: Subject to any disclaimer, the term of this patent is extended or adjusted under 35 U.S.C. 154(b) by 0 days.

(21) Appl. No.: 16/421,555

(22) Filed: May 24, 2019

(65) Prior Publication Data

US 2019/0358658 A1 Nov. 28, 2019

(30) Foreign Application Priority Data

May 24, 2018 (DE) ..... 102018112442.2

(51) Int. Cl.
*B05B 11/00* (2006.01)

(52) U.S. Cl.
CPC .... *B05B 11/3022* (2013.01); *B05B 11/00442* (2018.08); *B05B 11/3015* (2013.01); *B05B 11/3064* (2013.01)

(58) Field of Classification Search
CPC ..... B05B 11/3022; B05B 11/3015; B05B 11/3064; B05B 11/00442; B05B 11/3084
See application file for complete search history.

(56) References Cited

U.S. PATENT DOCUMENTS 4,369,900 A * 1/1983 Saito ..... B05B 11/3018 222/321.2
5,497,915 A * 3/1996 Wass ..... B05B 11/3015 222/153.07
6,209,760 B1 * 4/2001 Fuchs ..... B05B 11/3035 222/321.6
9,410,837 B2 * 8/2016 Brugger ..... B05B 11/3015
10,051,940 B2 * 8/2018 Brugger ..... B01F 5/0666
10,583,450 B2 * 3/2020 Brugger ..... B05B 11/3073
10,661,290 B2 * 5/2020 Brugger ..... B05B 11/0078
2001/0022309 A1 * 9/2001 Garcia ..... B05B 11/3074 222/385
2005/0115988 A1 * 6/2005 Law ..... B05B 11/3087 222/145.5
2006/0054633 A1 * 3/2006 Brugger ..... B05B 11/3083 222/94
2019/0321842 A1 * 10/2019 Brugger ..... B05B 11/3069

FOREIGN PATENT DOCUMENTS

DE 69229450 T2 8/1992
DE 20208173 U1 5/2002
DE 60104119 T2 8/2005
DE 202007006997 U1 10/2007
DE 202007018065 U1 6/2009

OTHER PUBLICATIONS

DE search report, dated May 24, 2018.

* cited by examiner

*Primary Examiner* — J C Jacyna
(74) *Attorney, Agent, or Firm* — FisherBroyles, LLP; Craig Mueller

(57) ABSTRACT

A dosing dispenser for dosing of at least one material component respectively received in a receiving compartment. In a dosing dispenser for the discharge of material components that has a double-walled structure of the pump unit, a ventilation path is provided leading from the outer environment to the receiving compartment through the pump unit.

19 Claims, 13 Drawing Sheets

J-J ( 2 : 1 )

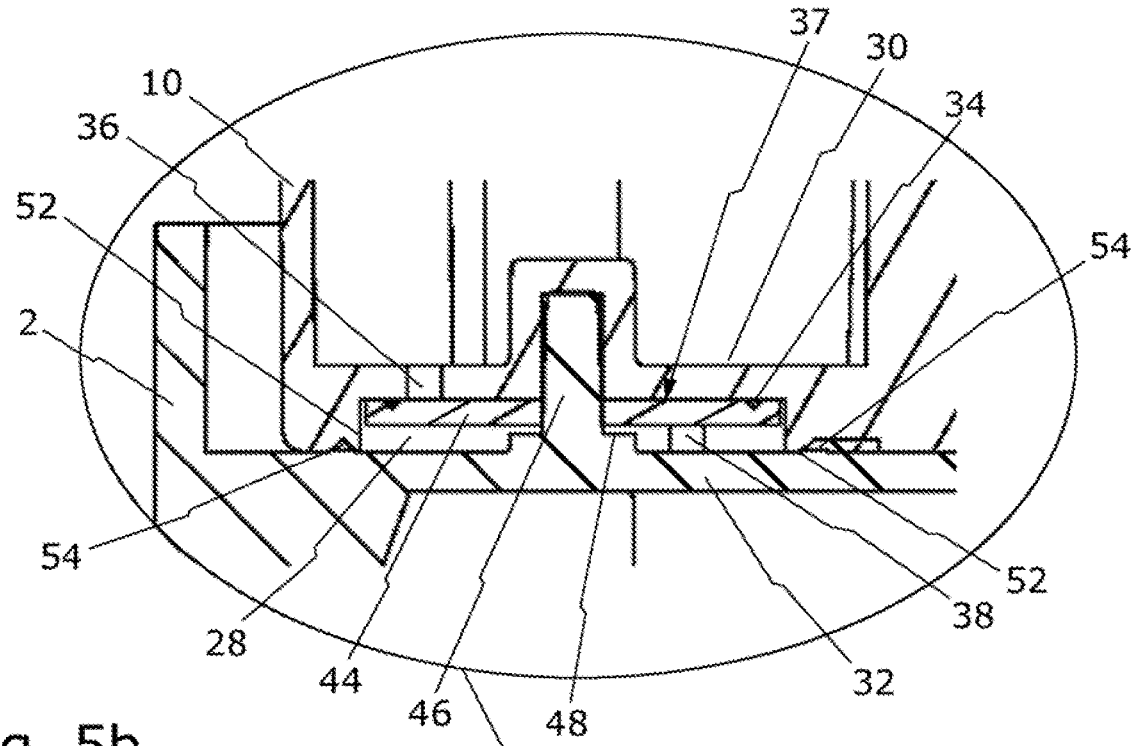
Fig. 5b
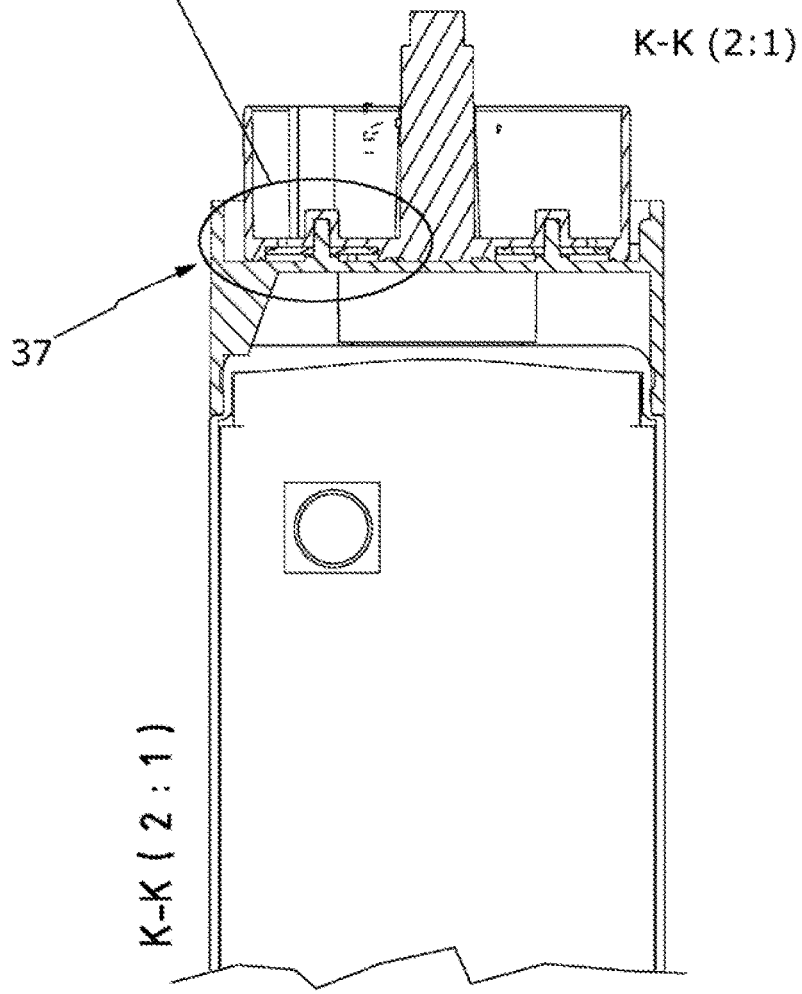

DOSING DISPENSER FOR DOSING OF AT LEAST ONE MATERIAL COMPONENT RECEIVED IN A RECEIVING COMPARTMENT

This application claims the benefit of German Patent Application No. 102018112442.2, filed May 24, 2018, the entire disclosure of which is incorporated be reference herein.

SUMMARY OF THE INVENTION

The invention relates to a dosing dispenser according to the preamble of claim 1.

In particular, the present invention relates to dosing dispensers having a structure of the type as is represented and described, for example, in DE 202 07 029 U1, DE 202 08 173 U1 or DE 20 2007 018 065 U1 or in the patent application P 10 2018 109 815, respectively. In these dispensers a pump housing is inserted in a housing, namely in cylindrical receptacles of the housing, into which the pump cylinder of the pump housing engages such that a double-wall structure is formed between the cylindrical receptacle and the pump cylinder. At the lower end of the housing, receiving compartments, preferably incorporated for the discharge of material components, are preferably incorporated via clamping and snap connections. Supply hoses in the interior of the receiving compartments are material-conducting connected, under interposition of valves, with the bottom of the cylindrical receptacles and the pump cylinder. Due to the timing of the piston engaging in the pump cylinder by up and down movement, an intake stroke is carried out drawing material from the receiving compartments, and thereupon a compression stroke is carried out by which the material, received within pumping chambers formed in the pump cylinder, is conveyed via an annular gap between pump cylinder and cylindrical receptacle toward a tower-like outlet that passes the discharged material to the applicator. Since due to the timing of the piston a negative pressure is always established due to the intake stroke in the interior of the receiving compartments, a ventilation of the receiving compartments is required, the compartments being formed in a known manner by containers, bags and the like. Here, the ventilation is carried out as a rule via own valves that are arranged or formed, respectively, at the walls of the receiving compartments. These valves are inconvenient inasmuch as they are to be separately inserted into the receiving compartments, may clog and also cannot prevent leakage of material from the dosing dispenser.

It is the object of the invention to provide dosing dispensers based on the construction previously described, rendering possible a ventilation in a simple and safe manner and to avoid preferably undesirable leakages of material to the outside.

This object is solved according to the invention by the features stated in claim 1 wherein appropriate embodiments of the invention are characterized by the features stated in the dependent claims.

According to the invention, a dosing dispenser has a ventilation path in the housing and in the pump housing inserted therein, respectively, which connects respectively a receiving compartment of the dispenser with the outer environment.

According to the invention, the ventilation path from the receiving compartments is integrated in this way into the housing and the pump housing inserted therein, which brings about production-related advantages and allows for a safe and proper ventilation of the receiving compartment during the timing by the piston. At the same time, the number of components is reduced.

According to the invention, it is further convenient that the dosing dispenser has a sealing means which separates the ventilation path, that is formed or provided within the housing and the pump housing inserted therein, with respect to the material supply from the receiving compartment to the applicator leading outlet. Due to such a sealing means, any leakage of material to the outside will be eliminated in a reliable manner, which may arise because of, for example, tolerance-related deviations or signs of wear or assembly-related inaccuracies during assembly or during the use of the dosing dispenser.

In a convenient embodiment, a part of the ventilation path is formed by mutually aligned openings in the inner and outer wall of the double-walled wall structure of the housing and pump housing, i.e. by openings which are provided in the walls of the cylindrical receptacle and the pump cylinder and are mutually aligned and fluid-conducting. The sealing device is conveniently arranged in the interface area between the two cylindrical walls of the double-wall structure, so that the mutually aligned openings can be sealed in simple manner against any material entry, preferably against the material entry from the annular channel formed between the walls of the double-wall structure via which the material to be discharged from the pump cylinder to the outlet is conveyed by downward movement of the piston.

In a convenient manner, the sealing device is formed by a raised planar, preferably plane rectangular sealing shoulder that may be formed either in the area of the interface of the double-wall wall structure, either at the inside of the cylindrical receptacle or at the outside of the pump cylinder. Here, the sealing shoulder is in sealing contact with the mating surface, whereby the openings in this interface area may be sealingly bridged. Since the sealing shoulder is two-dimensionally formed and preferably raised, appropriate seal can be guaranteed in a simple manner by appropriate tolerances, material selection and the like.

In an advantageous manner, the sealing device may also be provided at its sealing surface with another sealing means. For this purpose, a sealing ring is suitable which is disposed at the sealing shoulder, preferably in the manner of an O-ring, that can be inserted into the sealing shoulder and sealingly surrounds the corresponding opening. Furthermore, the formation of sealing webs is suitable on the sealing shoulder, which surround the openings, so that by ultra-welding in the area of the sealing webs a perfect sealing is achieved with the mating surface. In addition, a corresponding sealing covering, such as a rubber coating and the like, or a sealing adhesive bonding between sealing shoulder and mating surface is also suitable. Thereby a lasting and stable seal is also guaranteed.

For a simplified construction it is convenient to arrange one of the extensions, formed preferably by axial webs bridging the annular channel, in the area of the aligned opening, wherein the extension having a corresponding opening may be embedded between the sealing shoulder or may be, for example, integrally formed with the sealing shoulder.

Conveniently, the pump piston has preferably at its free front end two annular sealing webs arranged at a distance from one another, which are configured to be in distance of one another in such a way that they cover in the rest position of the piston, in which the piston is raised toward the applicator, the openings formed in the double-wall structure of the pump cylinder and the cylindrical receptacle and thereby block the ventilation path. If the piston is pushed in a downward direction in order to eject material out of the pumping chamber, the sealing rings release the ventilation openings of the double-walled structure so that air can pass from the outside via the openings into the interior of the receiving compartments. Thus, the provision for an appropriate ventilation is simplified by arranging the ventilation path in the housing and the pump housing.

In another alternative and very advantageous embodiment, the ventilation path is completely separated from the material supply and the ventilation opening is disposed outside of the pump cylinder, preferably laterally offset from the pump cylinder. Preferably, a valve device is provided here below the ventilation opening, preferably below the bottom of the pump housing, to seal against leakage-induced material discharge. Here, the valve device opens conveniently the ventilation path during the intake strokes of the piston, whereas otherwise, i.e. in the compression stroke, but also due to self-bias of components of the valve device, this is closed and thereby blocks the ventilation path where, however, no material discharge whatever due to leakage is made possible.

Conveniently, the valve device is provided in a chamber between the pump housing and the housing receiving the pump housing, preferably in at least one recess at the bottom of the pump housing, outside of the pump cylinder formation. On the one hand, the ventilation opening connected with the outer environment opens into this chamber and, on the other, a channel leads preferably laterally out of the interior of the chamber that represents part of the ventilation path and leads to an opening in the bottom of the housing which communicates with the corresponding receiving compartment for the purpose of the ventilation thereof, is in fluid communication. Here, it is expedient that the chamber is completely sealed to the outside, so that a perfect separation between the ventilation path and the material supply path is achieved from the pump cylinder via the annular channel in the outlet. For the purpose of sealing, the above-mentioned peripheral sealing webs are suitably positioned at the bottom of the pump housing and/or of the housing or at both mutually facing bottom surfaces which allow particularly by ultra-welding for a cohesive composite between the two bottoms and a cohesive composite between housing and pump housing as well. In this way, a simple and perfect, long lasting and stable sealing is guaranteed.

Conveniently, the valve device provided in the chamber has a sealing disc that, preferably, may be formed annularly and may be centered on a nose at the bottom of the housing. Conveniently, this sealing disc is made of a resilient material, preferably rubber. In the relaxed state, the sealing disc is at the ventilation opening in the bottom of the pump housing and is deflected downward during the intake stroke of the piston due to negative pressure which is established in the chamber below the valve disc, so that the locking position is canceled and the ventilation path is opened. As soon as the suction pressure ends, such as by downward movement of the piston or, if the piston is then in the upper rest position, the valve disc moves from its articulated and resiliently biased direction again upwards, so that the valve disc then enters again the locking position in which the supply opening in the bottom of the pump housing, serving for ventilation, is blocked.

The Summary of the Invention is neither intended nor should it be construed as being representative of the full extent and scope of the present invention. That is, these and other aspects and advantages will be apparent from the disclosure of the invention(s) described herein. Further, the above-described embodiments, aspects, objectives, and configurations are neither complete nor exhaustive. As will be appreciated, other embodiments of the invention are possible using, alone or in combination, one or more of the features set forth above or described below. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description and no limitation as to the scope of the present invention is intended by either the inclusion or non-inclusion of elements, components, etc. in this Summary of the Invention. Additional aspects of the present invention will become more readily apparent from the Detailed Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

FIG. 5*b* is a partial view of the dosing dispenser along line K-K in FIG. 5*a* in the scale of 2:1 as well as top left an enlarged representation of a detail of FIG. 5*a* or a valve device.

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Figure 1:
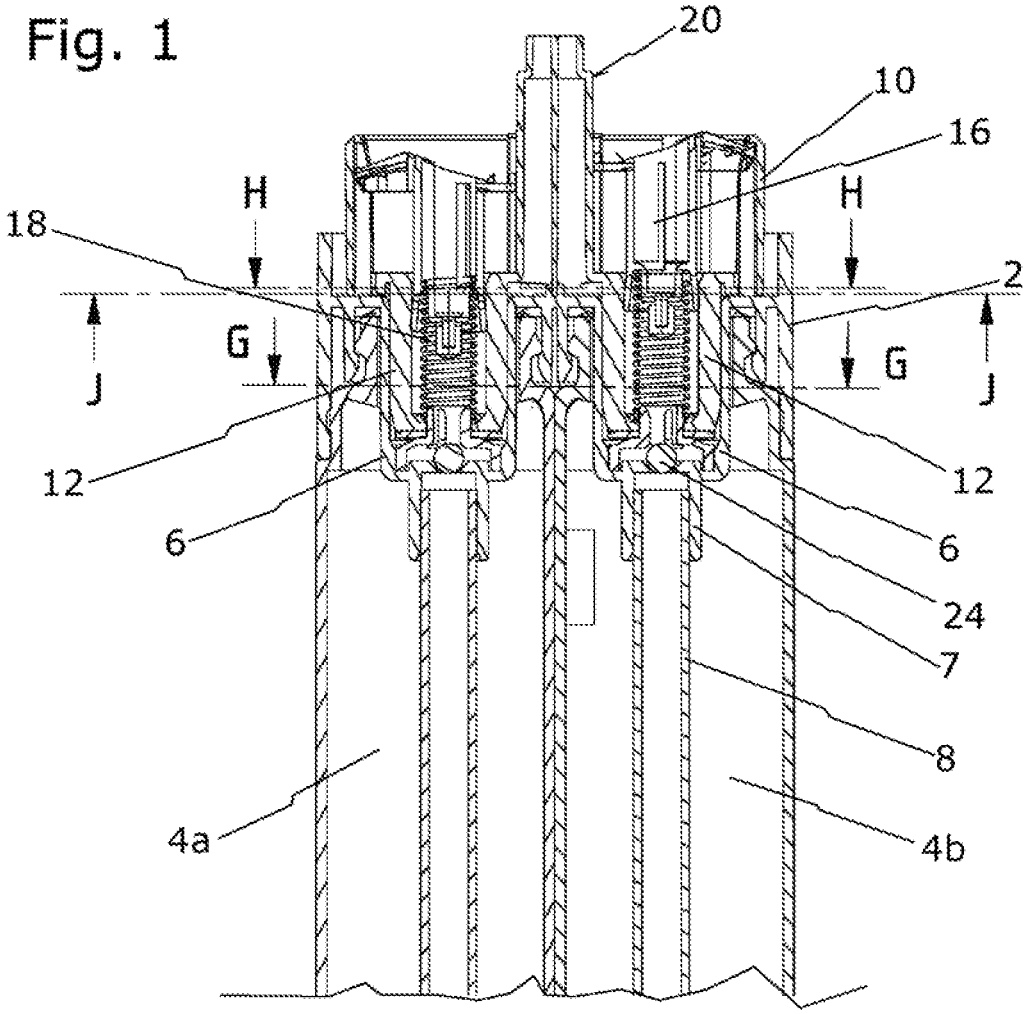
FIG. 1 is a sectional view through a dosing dispenser, that is formed for the purpose of dosing of two material components having two receiving compartments.

FIG. 1 shows a section through a dosing dispenser for dispensing materials, preferably cosmetics and similar viscous materials, in the represented embodiment for the discharge of two materials. FIG. 1 shows the basic structure of such a dosing dispenser that is in principle prior art, where, as stated already at the beginning, reference can be made to DE 202 07 029 U1, DE 202 08 173 U1 and DE 20 2007 018 065 U1. Thus, the basic structure arises also from the German patent application P 10 2018 109 815.4, which is why the following description is able to concentrate significantly on the further structural development of the invention of this type of a dosing dispenser.

FIG. 1 shows a partial view through such a dosing dispenser. The dispenser has a central housing 2 at which in the represented embodiment two receiving compartments 4*a*, 4*b* are arranged, that are formed in bottle-shape in the represented embodiment, but may generally represent containers, bags and the like. A definition is not intended here. The housing 2 has at least one cylindrical receptacle 6. In the represented embodiment it has two cylindrical receptacles 6 because of two receiving compartments by which hoses 8 reaching via an extension 7 arranged below into each receiving compartment 4*a*, 4*b* are attached. The housing 2 has a pump housing 10 inserted therein, which in this case is provided with two pump cylinders 12 that are inserted into the corresponding cylindrical receptacles 6 of the housing 2 leaving free an annular gap that is formed between the cylindrical receptacle 6 and the pump cylinder 12, respectively. The gap can be seen in the enlarged partial view of FIG. 6 and is denoted there by 14. This annular gap 14 is not visible from the sectional view in FIG. 1 because this section is taken through axial webs described further below, the webs bridging the annular gap between pump cylinder 12 and cylindrical receptacle 6 and arranged at the distance from each other. These axial webs can also be formed as extensions.

Figure 3:
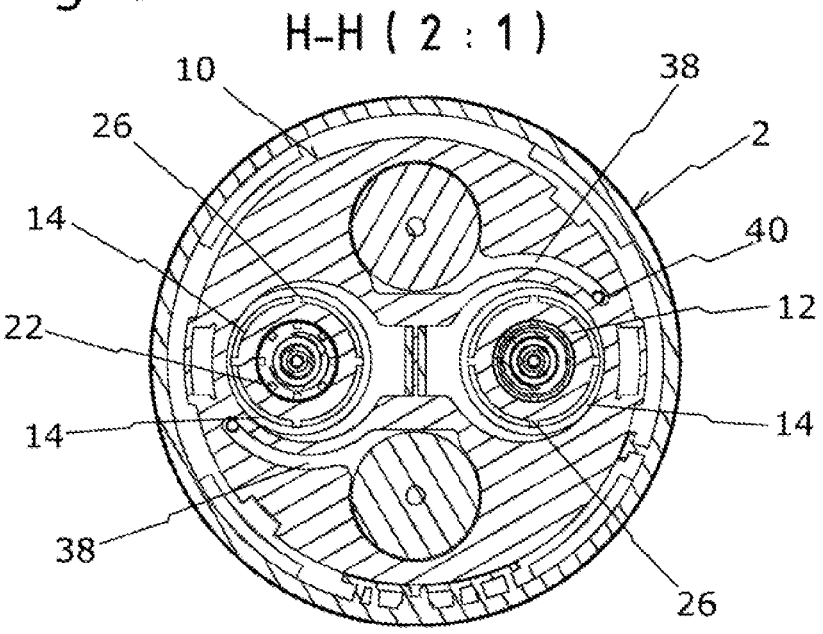
FIG. 3 is a sectional view along line H-H in FIG. 1.

Corresponding pistons 16 correspond to the pump cylinders 12, wherein a compression spring 18 is preferably arranged between piston 16 and the bottom of the cylindrical pump cylinder 12, respectively. The compression spring 18 brings the piston after completed downstroke again toward the upper position according to FIG. 1. In addition, the pump housing 10 comprises centrally a tower-like or columnar outlet 20, for example, which is divided in two by a centrally disposed web wall in the represented embodiment, wherein the outlet 20 leads to a known applicator that is not represented in the drawings. Finally, the material discharge takes place to the outside via the outlet 20 and the applicator arranged thereupon, such as on the skin, hand or hair of the user, depending on the orientation of the dosing dispenser. For the purpose of material discharge, the two pistons 16 are pushed first downward toward the bottom of the two pump cylinders 12 and are finally raised into the position represented in FIG. 1, whereby a suction pressure is created and material is led thereby via the two hoses 8 into both chambers of the two pump cylinders 12. By a subsequent downstroke of both pistons 16, the material present in the pump cylinder is led through openings 22 located at the bottom of the pump cylinder 12, which are represented in FIG. 3, into the annular channel 14 and from there toward the outlet 20 for material discharge, wherein this principle is due to the special construction of the dosing dispenser corresponding to the aforementioned documents. Between the pump cylinder 12 and the corresponding hose 8 there is located a valve 24 in each case. This does not have to be described in detail.

In constructions according to the state of the art, since a corresponding negative pressure is established due to pump actuation stroke by stroke in the receiving compartments, respectively, the receiving compartments have, for example, ventilation openings or valves so that the corresponding negative pressure may be reduced by ventilation of the receiving compartments. This is of significance for the mode of operation of the dosing dispenser, but entails the risk; however, that due to leakage and the like material may also escape from the dispenser. There are plastic components used throughout in the dosing dispenser. Because of tolerance, in the upper area with respect to the housing and the pump housing inserted therein leaks and therefore leakages of material may happen, in particular during the compression stroke of the piston, which can be disadvantageous and extremely unpleasant for the manipulation and the handling of the dosing dispenser.

Figure 5A:
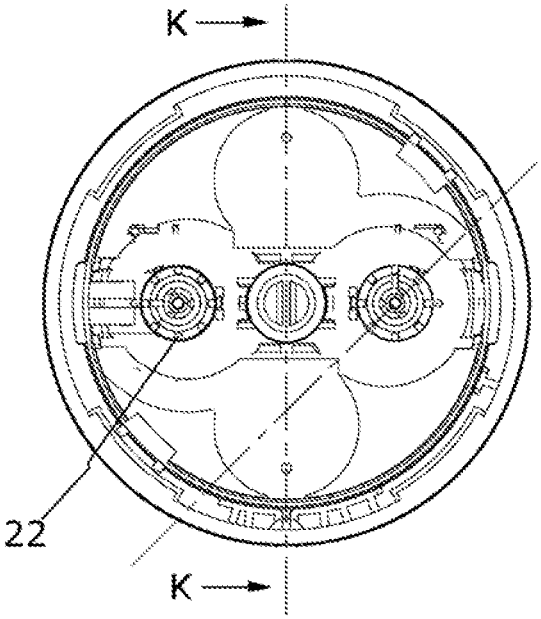
FIG. 5*a* is a plan view onto the dosing dispenser according to FIG. 1.
Figure 2:
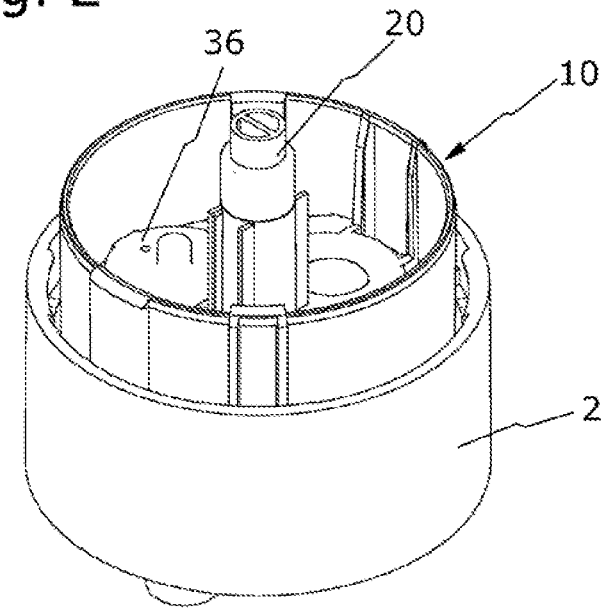
FIG. 2 is a perspective view of the upper area of FIG. 1 with housing and pump housing inserted therein.
Figure 4:
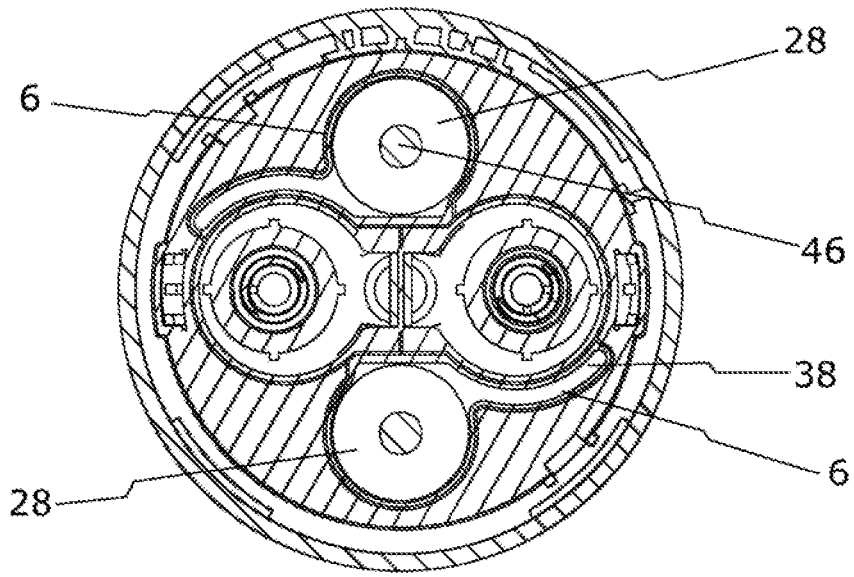
FIG. 4 is a sectional view along line J-J in FIG. 1.
Figure 12:
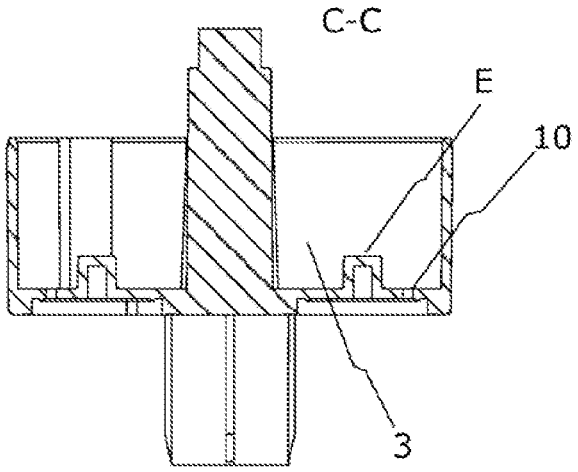
FIG. 12 is a sectional view of the pump housing along section line C-C of FIG. 9.
Figure 13:
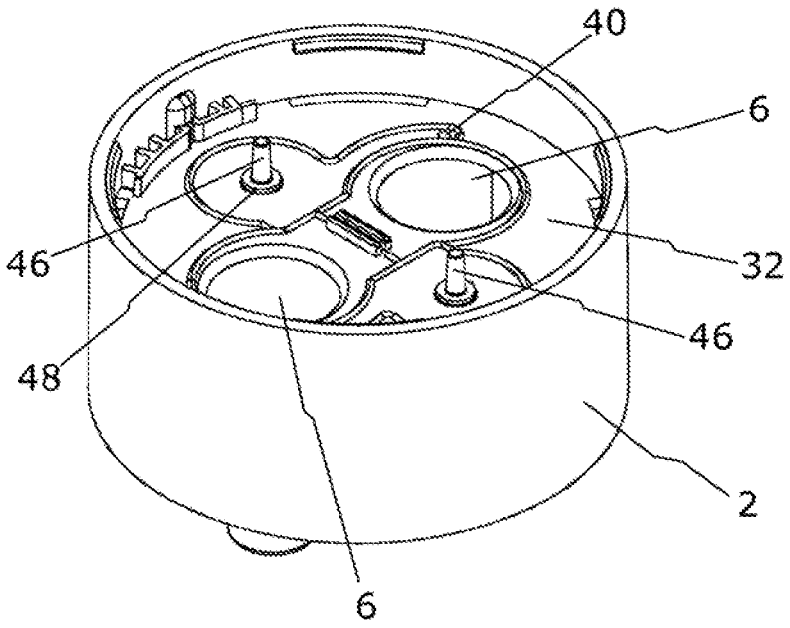
FIG. 13 is a perspective view of the housing for the receptacle of the pump housing, in a view seen from above.
Figure 14:
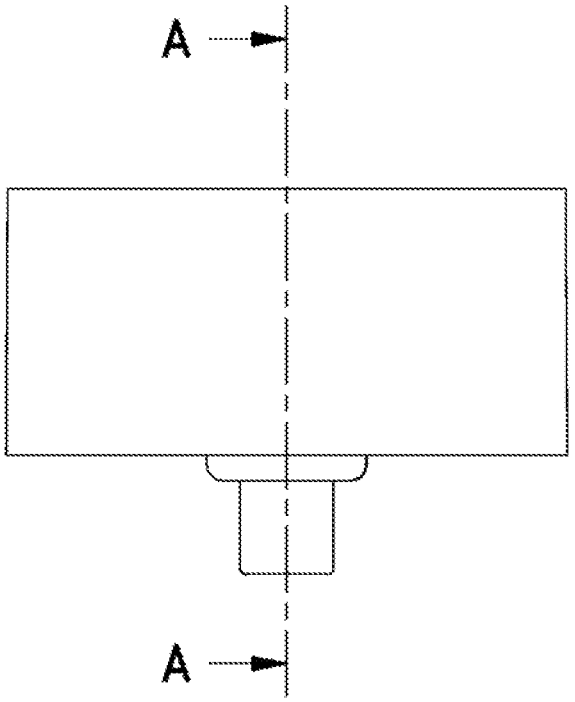
FIG. 14 is a side view of the housing represented in FIG. 13.
Figure 15:
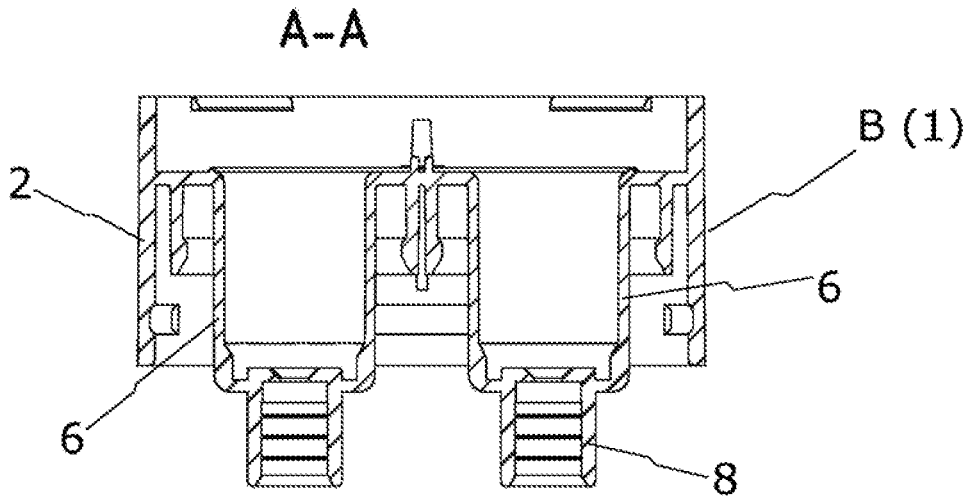
FIG. 15 is a sectional view of the housing along line A-A of FIG. 14
Figure 16:
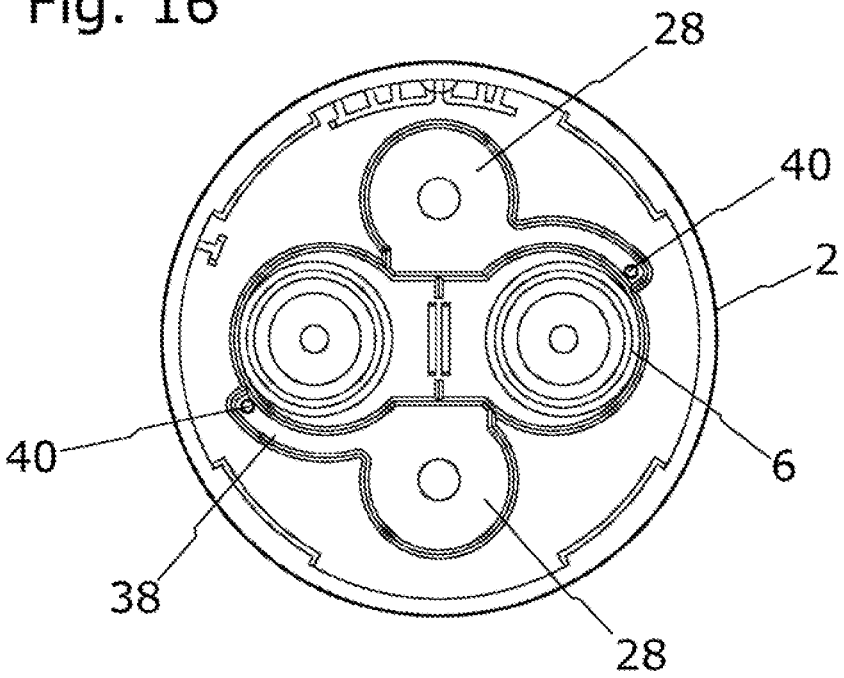
FIG. 16 is a plan view onto the housing.

In the embodiment of a dosing dispenser described in the following, a further development of the ventilation is carried out that is described with reference to FIGS. 2 to 16. FIG. 3 shows a section along line H-H through the upper area of the dosing dispenser formed of the housing 2 and the pump housing 10. The two pump cylinders 12 can be seen opposite to each other aligned with the corresponding receiving compartments. In addition, FIG. 3 shows also spaced extensions which are preferably formed as axial webs 26. The extensions are each formed at a distance around the pump cylinder 12 and bridge the annular channel 14 between pump cylinder 12 and cylindrical receptacle 6 as well. In this respect, i.e. with respect to FIG. 3 and the opposite arrangement of the two pump cylinders 12 offset by 90°, circular chambers 28 can be seen also from FIG. 4. The circular chambers 28 are again oppositely arranged and receive the valve device still to be described in the following. These chambers 28 can be seen best from the enlarged representation in FIG. 5*b*. The chambers 28 are formed between the pump housing 10 and the housing 2 at the bottom 30 of the pump housing and at the bottom 32 of the housing 2, which are front-end walls. In the represented embodiment, each chamber 28 is conveniently formed by a circular recess 34 in the bottom 30 of the pump housing 10, wherein in each chamber 28 a valve device 37, described below in greater detail (FIG. 5*b*), is incorporated. Only the left chamber is represented in FIG. 5*b*. Each chamber 28 is connected via a ventilation opening 36 with the outer environment which can be seen, by the way, from FIG. 2 and FIG. 12 as well. Corresponding to FIG. 3, a channel 38, forming a part of the ventilation path leading to the respective receiving compartment, passes from the chamber side wall from both chambers 28 to the outside (cf. for example FIG. 3 or FIG. 4). The channel 38 communicates with an opening 40 (FIG. 3 and particularly FIG. 13) passing through the bottom wall 32 of the housing 2 and is in fluid communication, respectively, with the corresponding receiving compartment 4*a* or 4*b* arranged below. The channel 38 thus forms part of the ventilation path leading from the opening 36 in the front-end bottom 30 of the pump housing via the chamber 28 and the channels 38 to the openings 40 (FIG. 13) and thereby to the corresponding compartments 4*a*, 4*b* for the purpose of ventilation. The valve device 37, seen particularly in FIG. 5*b*, is formed in the represented embodiment (purely by way of example) by an annular disc 44 preferably of rubber. The annular disc 44 represents a sealing disc and, corresponding to the representation in FIG. 5*b*, is in rest position at the underside of the bottom 30 of the pump housing 10 and seals here, as seen in FIG. 5*b*, the ventilation opening 36 so that in this state no ambient air can reach the respective receiving compartment via the ventilation path. Within the chamber 28, the sealing ring 44 is centered preferably in each case by a centrally arranged pin 46 at the lower bottom 32 of the housing (cf., for example, FIG. 13). Around the pin 46, an annular abutment shoulder 48 extends, as can be seen, for example, from FIG. 5*b* (enlarged representation top left) and FIG. 13. The chamber 28 is sealed all around to the outside except for the connection with the ventilation opening and the lateral outlet channel 38. For this purpose, sealing webs are preferably provided in the area of the contact portion between the bottom of the housing 2 and/or of the pump housing 10. By ultra-welding a heat fusion of these sealing webs is achieved and thereby a frictional connection takes place in the bottom area or in the contact portion between the two bottoms, respectively, whereby a sealing is achieved in a suitable manner. If necessary, the sealing webs alone may already provide for a corresponding sealing to the outside of the chamber 28. Of course, other suitable sealing measures are also convenient and are included within the scope of the invention.

Figure 6:
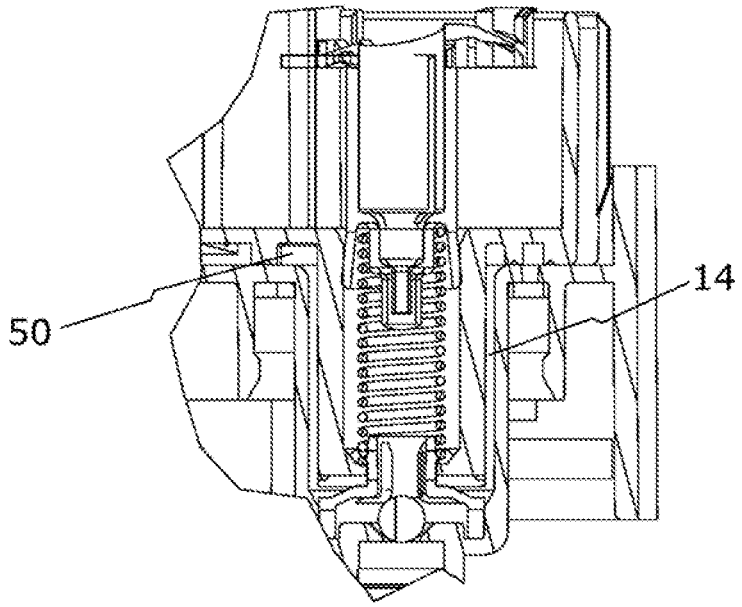
FIG. 6 is an enlarged representation of a part of the pump unit.
Figure 7:
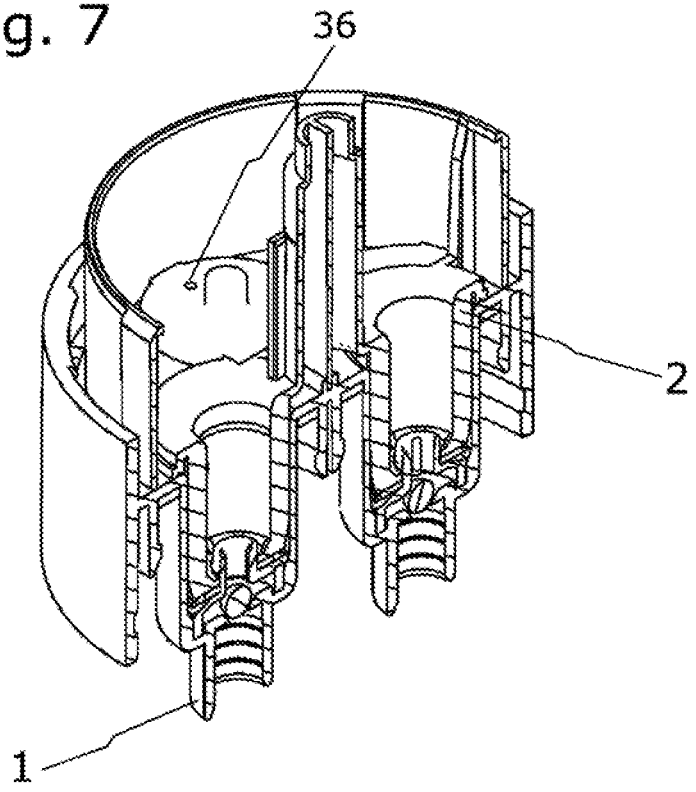
FIG. 7 is a sectional representation of the upper portions from FIG. 1 of the housing with pump housing inserted therein in perspective representation.
Figure 8:
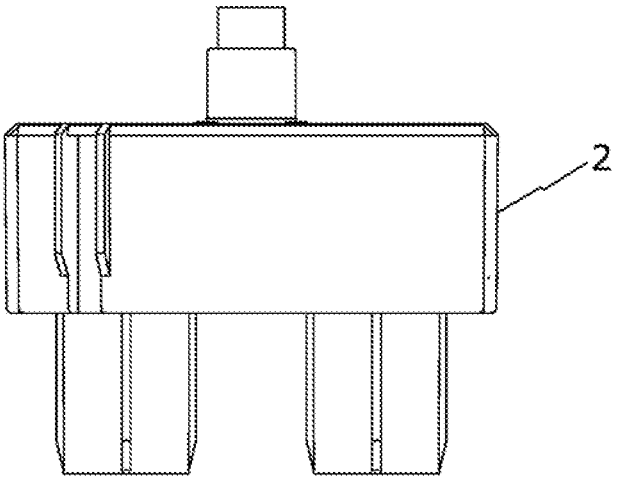
FIG. 8 is a side view of the pump housing.
Figure 9:
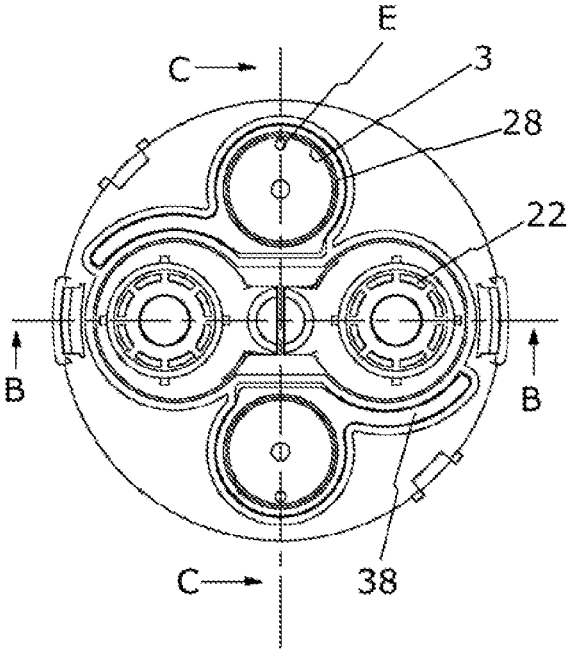
FIG. 9 is a plan view of the pump housing.
Figure 10A:
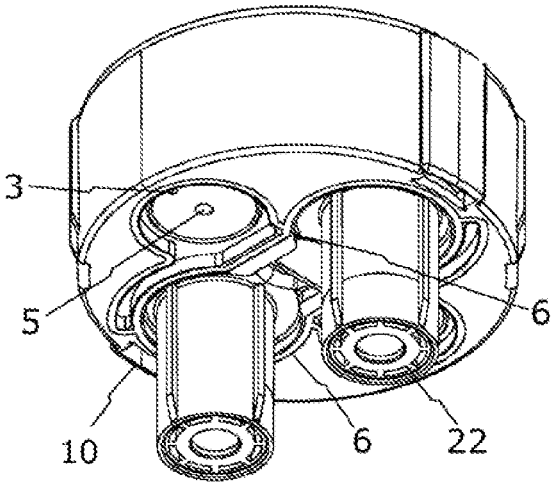
FIG. 10*a* is a perspective representation of the pump housing, seen from below.
Figure 10B:
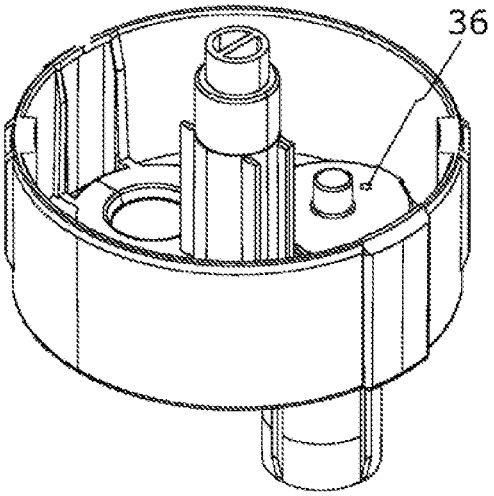
FIG. 10*b* is a perspective representation of the pump housing, seen from above.
Figure 11:
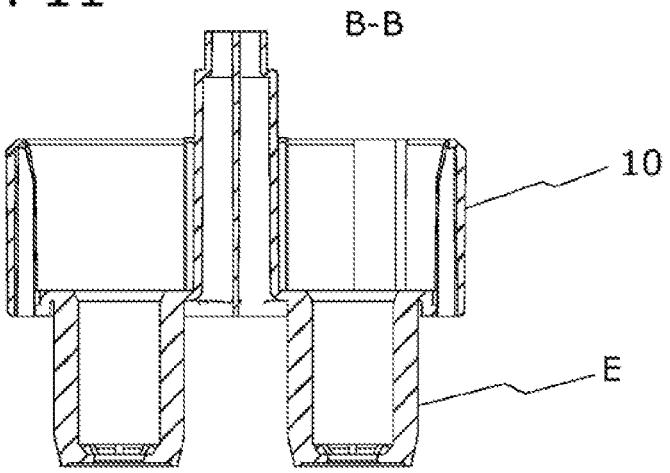
FIG. 11 is a sectional view of the pump housing along line B-B in FIG. 9.

In the embodiment according to FIGS. 1 to 16, the material supply from the pump cylinder 12 to the outlet 20 is carried out via the openings 22 placed at the bottom of the pump cylinder (FIGS. 3, 9 and 10*a*) to the annular channel (FIGS. 3, 6) and from there via another channel 50, seen from FIG. 6, to the central outlet 20. Due to tolerance-caused deviations, leakages cannot be excluded in these mass-produced articles. Therefore, leakage toward the ventilation path, particularly in the area of the annular chamber 14 to the outlet 20, may happen with the result, that material from the receiving compartments 4*a*, 4*b* can also reach the outside via the ventilation opening. According to the invention, this is prevented by the intermediate valve device 36. In the position as seen in FIG. 5*b*, neither a ventilation from the outside via the ventilation opening 37 nor a material discharge is possible due to the sealing disc 44 applied thereto, so that in this position a leakage will be prevented in any case. For the purpose of ventilation, the sealing disc 44, which is preferably made of rubber or a similar resilient material, deforms downward against and for engagement with the annular shoulder 48. The deformation particularly happens if suction pressure is produced by the ascent of the piston, which then causes lifting of the valve disc 44 downward, so that an influx of air is possible via the ventilation opening 36 from the outer environment in the direction of the receiving compartments. Due to the prevailing negative pressure, in this state, i.e. when the ventilation path is opened by the valve device, a leakage-induced material discharge is not possible via the ventilation opening. After completion of the intake stroke, however, the valve disc 44 closes again and is again at the ventilation opening 36, so that a lock is achieved. In this state, material cannot reach the outside, so that in this respect the sealing disc 44 acts as a valve disc with blocking function.

Here, the chamber 28 is appropriately hermetically sealed, which can take pace via the webs described above. According to the embodiment represented in the figures, protruding sealing webs are formed for this purpose, according to FIG. 5*b* at the peripheral edge of the chamber 28 or the recess 34, respectively, downward in direction on the bottom 32 of the housing 2. Furthermore for this purpose, in the represented embodiment, sealing webs 54 are, although not necessarily, conveniently arranged at the bottom 32 of the housing 2. The sealing webs 54 are arranged next to each other and preferably contact each other and can fuse by ultra-welding and hence by hot-melt bond, whereby the chamber 28 is hermetically closed to the outside. In this case, access to the ventilation opening 36 and to the channel 38 is only free from the respective chamber.

In this way, a free ventilation of the internal spaces of the compartments is achieved after each pumping stroke. Furthermore it is assured that no material can escape to the outside due to leakage, which otherwise could lead to contamination.

Another alternative embodiment of the invention will be described with reference to FIGS. 17 to 23, wherein the same reference numerals are used for same components. In this embodiment, the ventilation is carried out via the sides of the piston 16, i.e. along the outer periphery of the piston 16. Here, the ventilation path passes via mutually aligned openings 60, 62 (cf. FIG. 17) in the pump cylinder 12 and the cylindrical receptacle 6, whereby air from the outer environment, bypassing the piston 16 at a corresponding piston position, gets via the aligned openings 60, 62 into the interior receiving compartments suspended at the housing 2 (not apparent from FIG. 17) for the purpose of ventilation to cancel the negative pressure.

Figure 17:
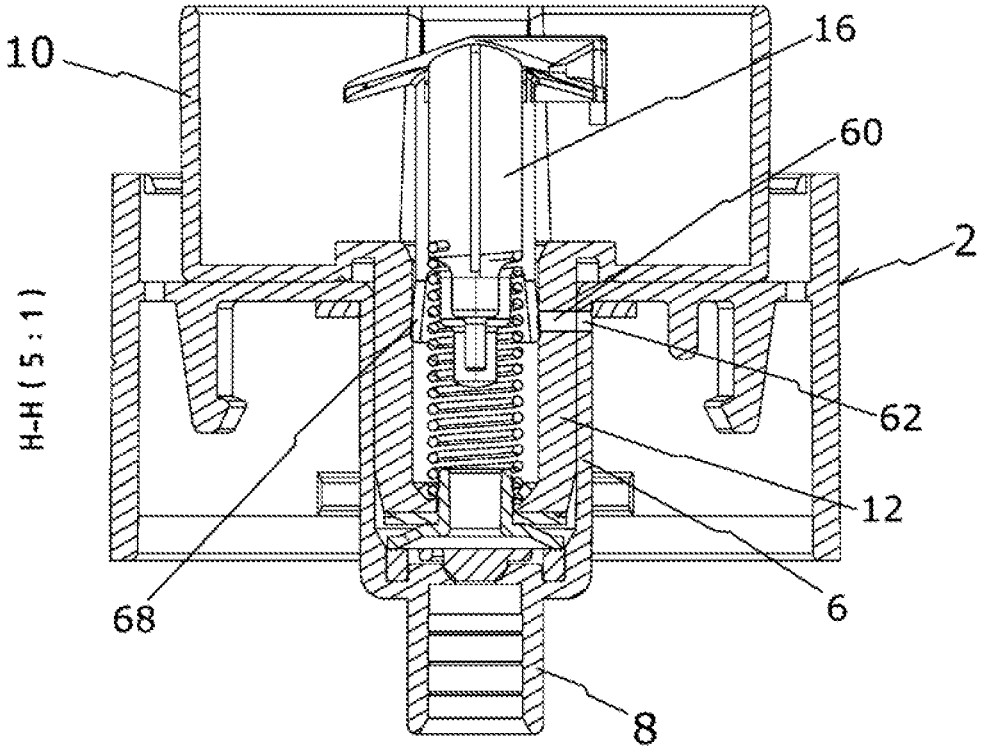
FIG. 17 is a representation of an alternative embodiment to FIGS. 2 to 16 in a sectional representation of a part of the upper area of the unit of housing with pump housing inserted therein according to FIG. 1 (in sectional view)
Figure 23:
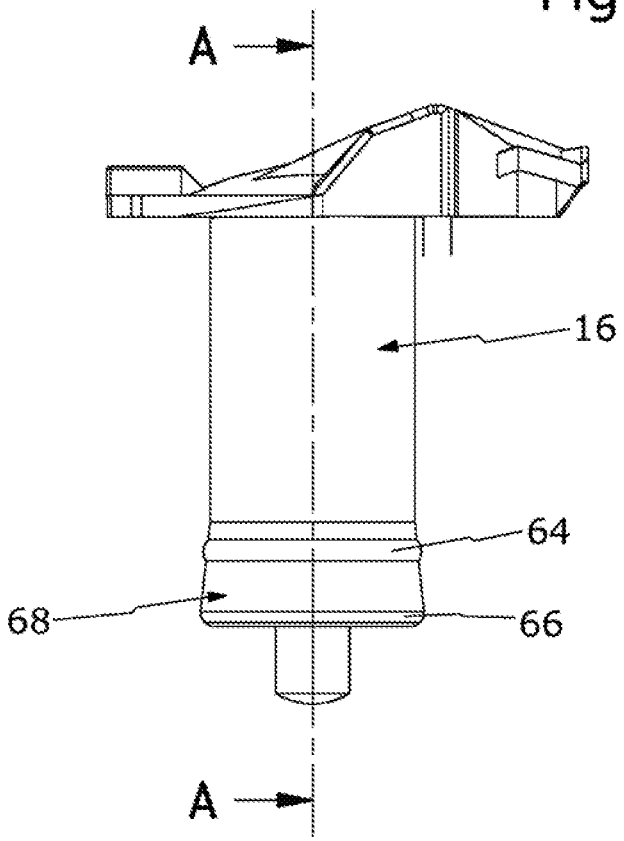
FIG. 23 is a side view of the pump piston according to FIG. 17.

The piston 16 also seen in FIG. 23 has preferably at its free front-end two ring-like sealing webs 64 and 66 arranged to one another in the distance, the distance of which is selected, such that these sealing rings 64, 66 bridge the mutually aligned openings 60, 62 in the double wall structure and block thereby in the position seen from FIG. 17 the openings 60, 62 and, consequently, block the ventilation path in direction to the receiving compartments. However, if the piston 16 is pressed down for the purpose of material discharge via the annular channels 14 and the outlet 20 (not represented in FIG. 17), the piston 16 passes by the openings 60, 62 with its sealing rings and releases these, such that ventilation is possible from the outer environment via the outer circumference of the piston 16. For this purpose, the piston 16 is conveniently provided at its free end with a conical widening 68 on which the sealing webs 64, 66 are formed, as is apparent from FIG. 23. Due to this conveniently conical widening of the free end of the piston 16, the piston section located behind is reduced in circumference so that in the manner described above, ambient air reaches the openings 60, 62, bypassing the piston, and thereby reaches the interior of the receiving compartments 4*a*, 4*b*. Regarding the possibility of leakage, the entire area between the outer surface of the pump cylinder 12 and the inner surface of the cylindrical receptacle 6 is critical, since leaks arise there due to tolerances and a corresponding material discharge may appear and the ventilation path and the path for the material supply to the outlet 20 may cross. Therefore, according to the embodiment of FIG. 17 and following figures a sealing device is provided at this interface, which is an alternative to the sealing device formed by the valve device 36 in the preceding embodiment. The sealing device is formed appropriately in the represented embodiment by a raised sealing shoulder 72 according to FIGS. 18 and 19. The sealing shoulder is formed at the inner surface of the cylindrical receptacle 6, preferably at the interface in the area of the two openings 60, 62 in the cylinder walls of the pump housing 10 and the housing 2 of the double wall structure, but which can also be formed alternatively at the outer surface of the pump cylinder 12. The sealing shoulder seals the gap in the walls between the two mutually aligned openings 60 and 62 in the area of the interface of the double wall structure.

Figure 18:
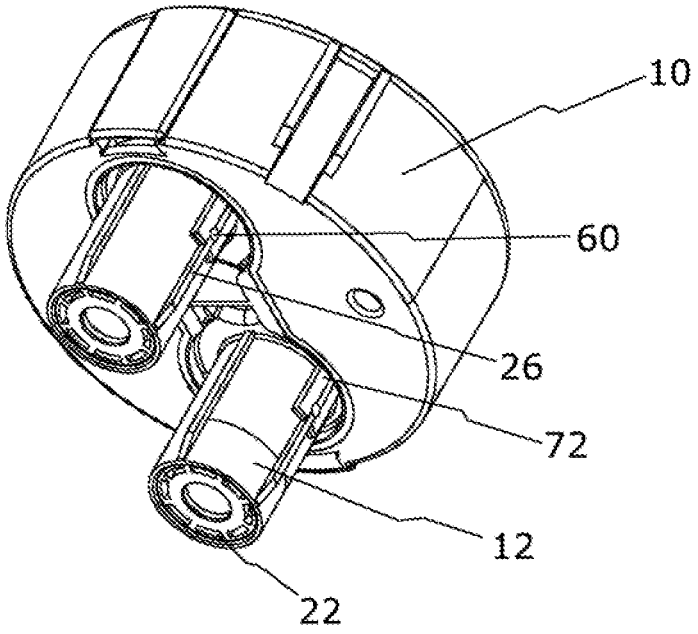
FIG. 18 is a perspective representation of the pump housing of FIG. 17.
Figure 19:
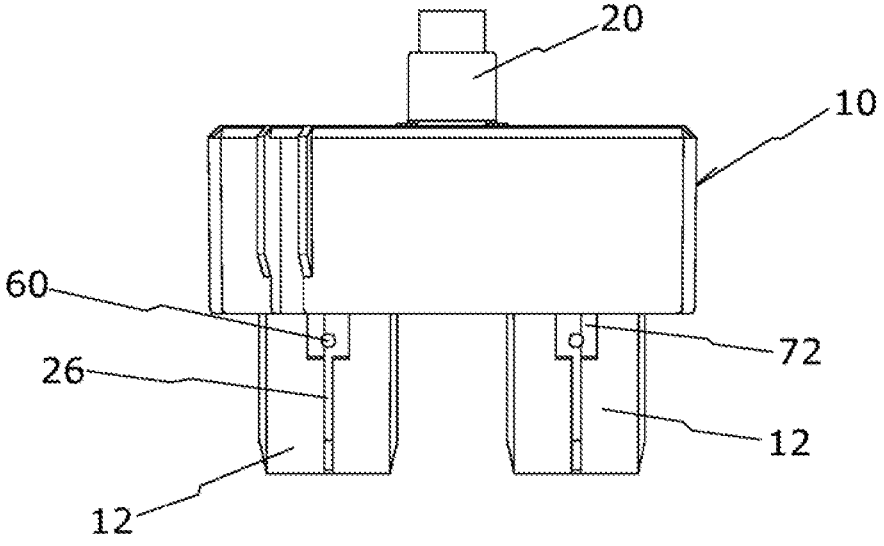
FIG. 19 is a side view of the pump housing of FIG. 18.
Figure 20:
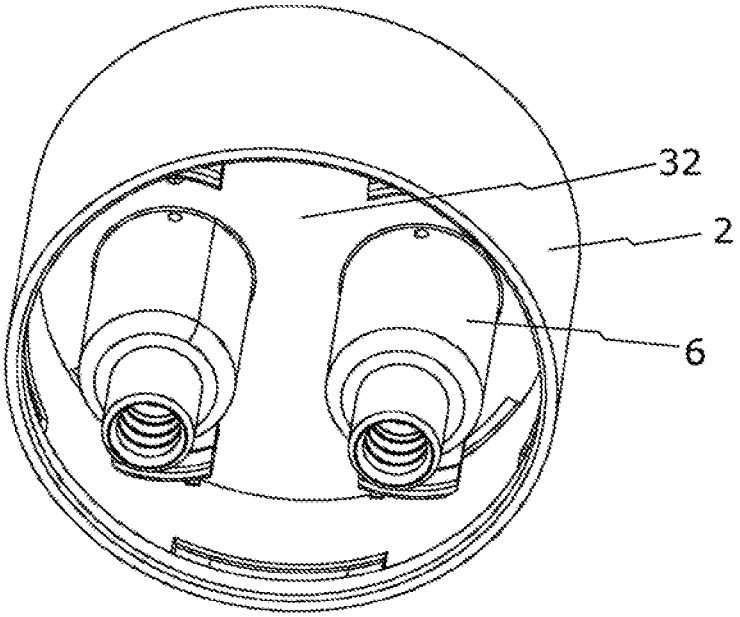
FIG. 20 is a perspective representation of the housing for the receptacle of the pump housing in a view from below.
Figure 21:
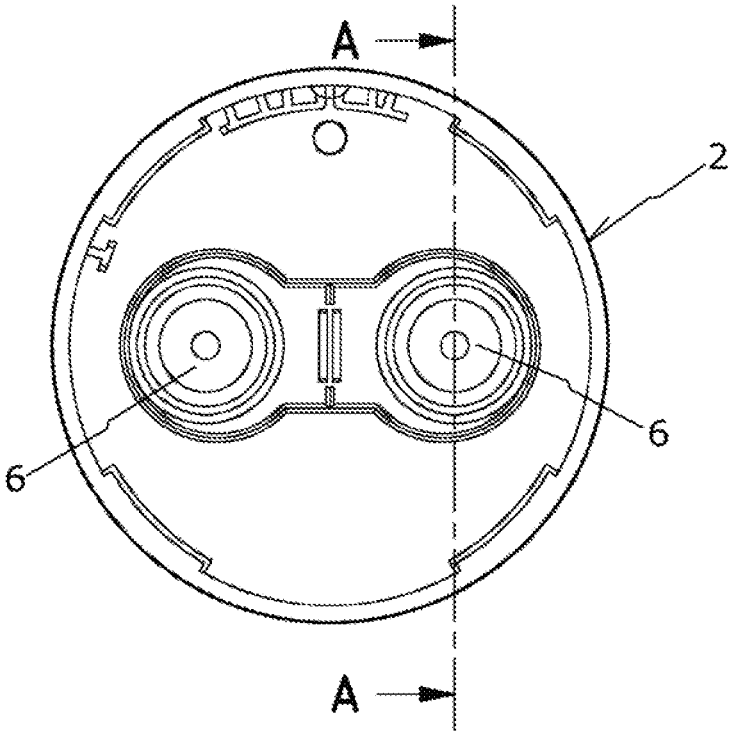
FIG. 21 is a plan view onto the housing.
Figure 22:
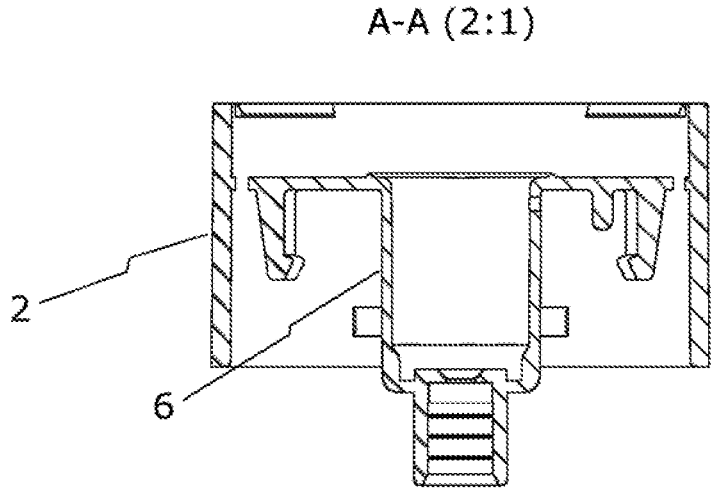
FIG. 22 is a sectional view along line A-A of FIG. 21.

From FIGS. 18 and 19, the extensions in form of exemplary axial webs 26 are also seen. The extensions bridge the annular channel between the walls of the double wall structure of the pump cylinder 12 and the cylindrical receptacle 6, which are formed in the embodiment represented with the sealing shoulder 72 in the opening portion. Depending on the respective embodiment, these extensions or webs 26 may penetrate through the sealing shoulder 72 or may also be integrally formed with the sealing shoulder, which is convenient as well. In this way the seal is concentrated on the raised sealing shoulder 72 that may appropriately be processed precisely in order to be able to meet their sealing function.

Here, it is expedient to provide this sealing shoulder with additional sealing measures. For this purpose, a rubber coating or similar sealing covering or seal coating, respectively, an adhesive bonding, an O-ring disposed around the opening, applied on the of the sealing shoulder 72, a peripheral sealing web, such as an ultrasonic welding and the like, is suitable, for example, in order to provide a corresponding beneficial sealing means. In this way, a perfect sealing is achieved against any leakage via the supply of material from the receiving compartment to the outlet 20.

While various embodiments of the present invention have been described in detail, it is apparent that modifications and alterations of those embodiments will occur to those skilled in the art. It is to be expressly understood that such modifications and alterations are within the scope and spirit of the present invention, as set forth in the following claims. Further, it is to be understood that the invention(s) described herein is not limited in its application to the details of construction and the arrangement of components set forth in the preceding description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

What is claimed is:

1. A dosing dispenser, comprising:

a housing with a receiving compartment adapted to receive at least one material component;

a cylindrical recess corresponding to the receiving compartment;

a pump unit comprising a pump housing interconnected to the housing, the pump housing having a pump cylinder that operatively receives a pump piston slidably arranged in the pump cylinder, the pump piston configured to perform an intake stroke, wherein pump cylinder movement transfers the at least one material component from the receiving compartment to an applicator having an outlet;

wherein the cylindrical recess and the pump cylinder form a double-wall structure consisting of an inner and outer wall that defines an annular channel adapted to receive the at least one material component as it discharges from the pump cylinder to the outlet, the annular channel being limited by extensions;

further comprising a ventilation path provided in the housing and in the pump housing, the ventilation path connecting the receiving compartment with an outer environment, the ventilation path having a ventilation opening provided in a bottom surface of the pump housing; and a valve device provided below the ventilation opening configured to selectively prevent at least one material component discharge, wherein the valve device opens the ventilation path during an intake stroke of the pump piston and closes the ventilation path during a compression stroke that initiates discharge of the at least one material component.

2. The dispenser according to claim 1, further comprising a sealing device separating the ventilation path with respect to the at least one material component from the receiving compartment to the outlet having the applicator.

3. The dispenser according to claim 1, wherein the ventilation opening is arranged outside of the pump cylinder.

4. The dispenser according to claim 3, wherein the valve device is disposed between the pump housing and the housing forming between each other a chamber for receiving the valve device.

5. The dispenser according to claim 1, wherein the ventilation opening opens into a chamber beneath the pump housing that communicates with a lateral channel, the lateral channel forming part of the ventilation path and leading to an opening in the bottom of the housing that leads into a receiving compartment.

6. The dispenser according to claim 5, wherein the chamber is sealed to the outside except for the opening forming part of the ventilation path.

7. The dispenser according to claim 6, wherein peripheral sealing webs are provided in the bottom of the pump housing and/or of the housing to seal the chamber.

8. The dispenser according to claim 7, wherein the webs define recesses in the bottom of the pump housing and/or of the housing and the channel, and wherein the sealing webs are connected by heat fusion with the respective opposite bottom.

9. The dispenser according to claim 5, wherein the valve device has a sealing disc disposed in the chamber and formed of flexible material, wherein in a locking position, the sealing disc abuts the pump housing at the opening, and wherein in an open position, the sealing disc is deflected downward in direction of the bottom of the housing.

10. The dispenser according to claim 1, wherein a path for the material discharge leads to a tower-like outlet via the pump cylinder, openings arranged at the lower end of the pump cylinder, and via the annular channel between pump cylinder and cylindrical receptacle.

11. The dispenser according to claim 1, further comprising a second receiving compartment arranged in the housing.

12. The dispenser according to claim 1, further comprising a second receiving compartment arranged in the housing, and further comprising a second pump cylinder associated with the second receiving compartment.

13. The dispenser according to claim 3, wherein the ventilation opening is arranged laterally offset from the pump cylinder in the pump housing.

14. The dispenser according to claim 4, wherein the valve device is disposed between the bottom of the pump housing and the bottom of the housing.

15. The dispenser according to claim 4, wherein the chamber is circular.

16. The dispenser according to claim 7, wherein the peripheral sealing webs are provided by ultra-welding.

17. The dispenser according to claim 8, wherein the webs encircle the recesses in the bottom of the pump housing and/or of the housing and the channel.

18. The dispenser according to claim 8, wherein the sealing webs are provided both at the underside of the bottom of the pump housing and at the top side of the bottom of the housing.

19. A dosing dispenser, comprising:

a housing having a first compartment adapted to receive a first material component and a second compartment adapted to receive a second material component;

first and second cylindrical recesses corresponding to the first and second compartments, respectively;

a pump unit comprising a pump housing interconnected to the housing, the pump housing having first and second pump cylinders that correspond to the first and second compartments, respectively, wherein each pump cylinder operatively receives a pump piston, wherein movement of the first and/or second pump cylinder transfers at least one of the first and second material component to an outlet of an applicator associated with the dosing dispenser;

wherein each cylindrical recess and corresponding pump cylinder form double-wall structures consisting of inner and outer walls that define annular channels adapted to receive at least one of the first and second material component as it discharges from the first or second pump cylinder to the outlet;

further comprising a first and second ventilation paths provided in the housing and in the pump housing, the ventilation paths connecting the first and second receiving compartments with an outer environment, the ventilation paths also having corresponding ventilation openings provided in a bottom surface of the pump housing; and a first and second valve devices provided below the ventilation openings configured to selectively prevent first and/or second material component discharge, wherein the valve devices open at least one of the ventilation paths during an intake stroke of the first and/or second pump piston and closes the at least one ventilation path during a compression stroke to initiate discharge of the first and/or second material component.

* * * * *